US012311244B2

(12) United States Patent
Blomberg et al.

(10) Patent No.: US 12,311,244 B2
(45) Date of Patent: May 27, 2025

(54) ASSISTIVE MOVEMENT TRAINING APPARATUS FOR THE DISABLED

(71) Applicant: Made For Movement Group AS, Skien (NO)

(72) Inventors: Fredrik Gardsteig Blomberg, Skien (NO); Christian Tuva-Stensland, Skien (NO); André Lindaas, Skien (NO)

(73) Assignee: Made For Movement Group AS, Skien (NO)

( * ) Notice: Subject to any disclaimer, the term of this patent is extended or adjusted under 35 U.S.C. 154(b) by 67 days.

(21) Appl. No.: 18/283,354

(22) PCT Filed: Mar. 22, 2022

(86) PCT No.: PCT/EP2022/057394
§ 371 (c)(1),
(2) Date: Sep. 21, 2023

(87) PCT Pub. No.: WO2022/200296
PCT Pub. Date: Sep. 29, 2022

(65) Prior Publication Data

US 2024/0149127 A1 May 9, 2024

(30) Foreign Application Priority Data

Mar. 22, 2021 (EP) ..... 21163978

(51) Int. Cl.
*A63B 69/00* (2006.01)
*A63B 21/00* (2006.01)
(Continued)

(52) U.S. Cl.
CPC .... *A63B 69/0064* (2013.01); *A63B 21/00181* (2013.01); *A63B 23/0417* (2013.01);
(Continued)

(58) Field of Classification Search
CPC ..... A63B 69/0064; A63B 21/00181; A63B 23/0417; A63B 69/0062; A63B 71/0009;
(Continued)

(56) References Cited

U.S. PATENT DOCUMENTS 6,390,954 B1 * 5/2002 Lee ..... A63B 22/001 482/52
6,440,046 B1 * 8/2002 Tholkes ..... A61H 1/0237 482/142

(Continued)

FOREIGN PATENT DOCUMENTS

WO WO 2008/103052 A2 8/2008
WO WO 2012/101574 A2 8/2012
WO WO 2013/043058 A2 3/2013

OTHER PUBLICATIONS

European Patent Office, International Search Report in International Patent Application No. PCT/EP2022/057394, 3 pages, dated Jun. 28, 2022 (as mailed).

(Continued)

*Primary Examiner* — Garrett K Atkinson
(74) *Attorney, Agent, or Firm* — Leydig, Voit & Mayer, Ltd.

(57) ABSTRACT

The present invention relates to the field of medical devices. In particular, the present invention relates to an apparatus (10) for assisting the movement of a subject, such as a patient or disabled person, to train and strengthen the muscles of their body, said apparatus (10).

16 Claims, 9 Drawing Sheets

(51) Int. Cl.
*A63B 23/04* (2006.01)
*A63B 71/00* (2006.01)

(52) U.S. Cl.
CPC ..... *A63B 69/0062* (2020.08); *A63B 71/0009* (2013.01); *A63B 2208/0204* (2013.01); *A63B 2208/0233* (2013.01); *A63B 2225/093* (2013.01)

(58) Field of Classification Search
CPC .... A63B 2208/0204; A63B 2208/0233; A63B 2225/093; A63B 22/208; A63B 21/068; A63B 2022/0094; A63B 2225/09; A63B 21/00178; A61G 5/14; A61G 7/1038; A61G 7/1046; A61H 1/0262; A61H 2201/1633; A61H 3/008; A61H 2205/106
See application file for complete search history.

(56) References Cited

U.S. PATENT DOCUMENTS 7,611,446 B2 * 11/2009 Chuang ..... A63B 22/001 482/52
9,044,639 B2 * 6/2015 Chia ..... A63B 22/0605
9,050,498 B2 * 6/2015 Lu ..... A63B 21/154
9,138,614 B2 * 9/2015 Lu ..... A63B 22/0664
9,248,071 B1 * 2/2016 Benda ..... A63B 71/0009
10,758,774 B2 * 9/2020 Tholkes ..... A63B 22/001
11,083,924 B2 * 8/2021 Borisoff ..... A63B 23/03575
2007/0161463 A1 * 7/2007 Eschenbach ..... A63B 22/001 482/52
2009/0075786 A1 * 3/2009 Merli ..... A63B 22/001 482/63
2011/0028277 A1 * 2/2011 Merli ..... A63B 23/03575 482/63
2014/0051552 A1 * 2/2014 Habing ..... A63B 22/0664 482/52
2014/0194256 A1 * 7/2014 Huang ..... A63B 23/03591 482/52
2014/0243157 A1 * 8/2014 Huang ..... A63B 22/203 482/52
2015/0141207 A1 * 5/2015 Eschenbach ..... A63B 22/001 482/52
2015/0165265 A1 * 6/2015 Tholkes ..... A61H 1/0262 482/57
2015/0246260 A1 * 9/2015 Giannelli ..... A63B 23/0476 482/8
2017/0136295 A1 * 5/2017 Tholkes ..... A61B 5/112
2019/0105530 A1 * 4/2019 Tholkes ..... A61G 5/14
2019/0231630 A1 * 8/2019 Tholkes ..... A61H 1/0266

OTHER PUBLICATIONS

European Patent Office, Written Opinion in International Patent Application No. PCT/EP2022/057394, 6 pages, dated Jun. 28, 2022 (as mailed).

* cited by examiner

ASSISTIVE MOVEMENT TRAINING APPARATUS FOR THE DISABLED

CROSS REFERENCE TO RELATED APPLICATIONS

This patent application is a U.S. National Phase of International Patent Application No. PCT/EP2022/057394, filed Mar. 22, 2022, which claims the benefit of European Patent Application No. 21163978.6, filed Mar. 22, 2021, each of which is incorporated by reference in its entirety herein.

FIELD OF THE INVENTION

The present invention relates to the field of medical devices. In particular, the present invention relates to an apparatus for assisting the movement of patients or disabled persons to train and strengthen the muscles of their body.

BACKGROUND

Mild to seriously disabled persons with limited control of their lower body experience difficulties getting the body into an upright position and start walking or moving. These persons may be affected by a variety of conditions including cerebral palsy, acquired brain and/or spinal injury, neurological conditions, multiple sclerosis, spina bifida. As a result, they are often confined to a lifestyle with very little to no physical exercise.

Prolonged physical inactivity and lack of stretching of the leg muscles will lead to the muscles developing atrophy. In the complete absence of physical training, these persons will therefore not only be subject to more progressive muscular weakening, but also develop secondary health problems due to poor blood circulation, cardiovascular diseases, reduced bone strength, poor digestion, disrupted sleep, painful spasticity, low mood and mental wellbeing, etc. The art recommends physical therapies that aim to keep the disabled person active and prevent the muscle from growing frail by preventing immobility, increasing muscle strength, improving circulation, reducing spasticity, etc.

EP2134308 describes an apparatus for training disabled persons by simulating different types of walking movements. However, that apparatus is difficult for the disabled person to enter and secure him/herself without nearby assistance, such as from a healthcare professional. Moreover, the configuration of the apparatus can also make it difficult to adjust the training to the individual needs of the disabled person, based on e.g. the user's body, sex, and the degree of disability. As a result, initiating and/or adjusting the apparatus settings may be tiring for the user and the assisting person. Accordingly, there is a need for an improved movement assisting apparatus to provide a solution to the problems in the art.

SUMMARY OF THE INVENTION

The present invention aims to provide a solution to the above-identified problems in the art by providing a movement assisting apparatus as described in the present disclosure for training a subject. The movement assisting apparatus can improve the user-friendliness and access for the subject to person to engage with the apparatus and adjust the training programme with limited assistance. Moreover, the present apparatus can provide for improved comfort which can improve the subject adherence to the training programme, thereby resulting in better health improvements.

Additional advantages brought about by embodiments of the present apparatus are discussed throughout the present disclosure.

An initial overview of various aspect of the invention is provided below and specific embodiments are then described in further detail. This initial overview is intended to aid readers in understanding the technological concepts more quickly, but is not intended to identify key or essential features thereof, nor is it intended to limit the scope of the present subject-matter.

An aspect of the present disclosure relates to an apparatus 10 for assisting the movement of a subject during a training session comprising: a frame having an elongated base and an upright support member 31 positioned at the front of the apparatus; a support unit 2 comprising a bottom support 21, a back support 22, an upper body securing device 24 and a switching mechanism 23 configured to selectively switch the position of said bottom 21 and back 22 supports between at least two states, namely a seated state wherein the bottom support 21 is substantially perpendicular to the back support 22, and a standing state wherein the bottom support 21 is substantially parallel, preferably aligned, with the back support 22, and vice versa; a movement assistance unit comprising, for each subject's leg, a foot fastener 33), a leg securing device 34, and a movement mechanism 32 consisting of an assembly of elongated bars hingedly connected to each other, including at least one vertical bar 321 that is pivotally coupled to the upright support member 31 and extends downward therefrom in a substantially vertical manner, and at least one horizontal bar 322 that is pivotally coupled to an opposite end of the apparatus and extends along the elongated base in a substantially horizontal manner, such that an elliptical leg movement path can be realised with said assembly 321,322; wherein the foot fastener 33 and leg securing device 34 are arranged on said horizontal bar 322; and, wherein the leg securing device 34 comprises a shackle 341 and a height-adjusting mechanism 342 configured to adjust the height of said shackle 341 to a position adjacent to, preferably below, the subject's knee joint; such that the shackle 341 secures the subject's leg at the pivot point of the knee when the switching mechanism 23 switches between the seated and standing states; and, wherein the movement assistance unit comprises a pulling mechanism that is connected to each shackle 341 and is configured to pull one shackle 341 back when the other shackle 341 moves forward, thereby providing an alternating leg movement.

Another aspect of the present disclosure relates to an apparatus 10 for assisting the movement of a subject during a training session comprising: a frame having an elongated base and an upright support member 31 positioned at the front of the apparatus; a support unit 2 comprising a bottom support 21, a back support 22, an upper body securing device; wherein said support unit 2 is mounted on a rotatable base 26 configured to rotate the support unit 2 around the apparatus' vertical such that at least the bottom support 21 and the back support 22 can be oriented sideways for subject entry [to allow the subject to enter the device]; and a switching mechanism 23 configured to selectively switch the position of said bottom 21 and back 22 supports between at least two states, namely a seated state wherein the bottom support 21 is substantially perpendicular to the back support 22, and a standing state wherein the bottom support 21 is substantially parallel preferably aligned with the back support 22, and vice versa; a movement assistance unit comprising, for each subject's leg, a foot fastener 33, a leg securing device 34, and a movement mechanism 32 consisting of an assembly of elongated bars hingedly connected to each other, including at least one vertical bar 321 that is pivotally coupled to the upright support member 31 and extends downward therefrom in a substantially vertical manner, and at least one horizontal bar 322 that is pivotally coupled to an opposite end of the apparatus and extends along the elongated base in a substantially horizontal manner, such that an elliptical leg movement path can be realised with said assembly; wherein the foot fastener 33 and leg securing device 34 are arranged on said horizontal bar 322; wherein the leg securing device 34 comprises a shackle 341 and a height-adjusting mechanism 342 configured to adjust the height of said shackle 341 to a position adjacent to, preferably below, the subject's knee joint; such that the shackle 341 secures the subject's leg at the pivot point of the knee when the switching mechanism 23 switches between the seated and standing states; wherein the movement assistance unit comprises a pulling mechanism that is connected to each shackle 341 and is configured to pull one shackle 341 back when the other shackle 341 moves forward, thereby providing an alternating leg movement.

In some embodiments the leg securing device 34 comprises a pivoting mechanism 343 configured to rotate the shackle 341 around a longitudinal axis of the height-adjusting mechanism 342; such that the shackle 341 can be rotated between at least two position, namely an inward position to secure the subject's leg and an outward position to release the subject's leg; preferably wherein the pivoting mechanism 343 comprises a locking member 345 configured to lock said shackle 341 in one of said at least two position.

In some embodiments the leg securing device 34 comprises a tilting mechanism 344 rotatably connected to the foot fastener 33 at the height of the subject's ankle; and configured to tilt the shackle around the ankle's axis of rotation 341.

In some embodiments the leg securing device 34 comprises a stop member 346 that is configured to block at least a backward tilt of the shackle 341 to prevent overstretching of the subject's knee; preferably wherein said stop member 346 is positioned below the tilting mechanism 344 and is configured to contact a portion of the leg securing device 34 extending below said tilting mechanism 344.

In some embodiments the tilting mechanism 344 is configured to tilt the shackle 341 forward between at least two position, namely a downward position to enter the subject's leg and an upward position to secure the subject's leg.

In some embodiments the shackle 341 is at least partially open-ended; and consists of a rigid outer piece and a flexible inner piece that is configured to move towards said outer piece to reduce the pressure exerted on the subject's leg.

In some embodiments the switching mechanism 23 comprises an assembly of at least two adjacent rods, namely an upper rod 231 and a lower rod 232, which are rotatably connected at opposite ends to the bottom 21 and back 22 supports at an oblique angle so as to form a vertical parallelogram; whereby a rotation of said assembly 231, 232 simultaneously tilts the bottom support 21 and lifts the back support 22 to align in the standing state and intersect in the seated state.

In some embodiments the switching mechanism comprises a moveably arranged locking member 261 configured to lock the rotation of the rotatable base 26; wherein said locking member 261 is biased towards said assembly 231, 232 and is configured to unlock when the switching mechanism 23 is in the seated state.

In some embodiments the upper body securing device comprises at least two lateral engaging members 24 arranged on either side of the back support 22 and configured to laterally engage, preferably simultaneously, the subject's upper body under the arms.

In some embodiments the pulling mechanism comprises a swivelling body 323 arranged in the rear of the apparatus; wherein said swivelling body 323 has two wire attachments 324 arranged at opposite ends thereof; and wherein each shackle 341 is connected to a separate wire attachment 324 by means of a connecting wire such that the movement of each shackle is coupled to the rotation of said swivelling body 323.

In some embodiments the pulling mechanism comprises a tensioning mechanism 325 configured to adjust the position of the swivelling body 323 along the longitudinal axis of the elongated base to set the tension on the subject's leg.

In some embodiments the apparatus comprises at least one retractable wheel 5 and a retracting mechanism 51 configured to reversibly extend and retract said wheel 5.

In some embodiments the retracting mechanism 51 is connected to a locking member 52 disposed on the swivelling body 323 and configured to lock the retracting mechanism 51 when the position of the swivelling body 323 is adjusted by the tensioning mechanism 325.

In some embodiments the subject is disabled or movement impaired; preferably affected by cerebral palsy, acquired brain and/or spinal injury, neurological conditions, multiple sclerosis, spina bifida or a movement impairing condition.

BRIEF DESCRIPTION OF THE FIGURES

The following description of the figures of specific embodiments of the invention are merely exemplary in nature and is not intended to limit the present teachings, their application or uses.

Throughout the drawings, the corresponding reference numerals indicate the following parts and features: apparatus 10; support unit 2; bottom support 21; back support 22; switching mechanism 23; upper rod 231; lower rod 232; lateral engaging member 24; head support 25; rotatable base 26; locking member 261; locking member 262; height-adjustable base 27; upright support member 31; movement mechanism 32; vertical bar 321; horizontal bar 322; swivelling body 323; wire attachment 324; tensioning mechanism 325; lifting mechanism 326; foot fastener 33; leg securing device 34; shackle 341; height-adjusting mechanism 342; pivoting mechanism 343; tilting mechanism 344; locking member 345; stop member 346; hand holder 35; retractable wheel 5; retracting mechanism 51; locking member 52.

DETAILED DESCRIPTION

Figure 1A:
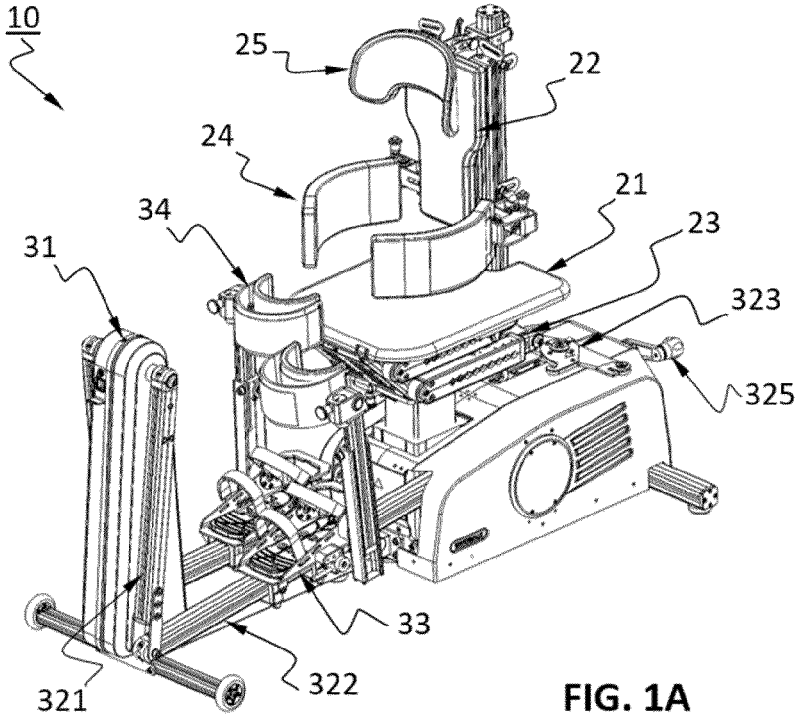
FIG. 1A is a perspective view and FIG. 1B a sideways view of the disclosed apparatus 10 in a seated state.

The present invention will be described with respect to particular embodiments, but the invention is not limited thereto but only by the claims. Any reference signs in the claims shall not be construed as limiting the scope thereof.

As used herein, the singular forms "a", "an", and "the" include both singular and plural referents unless the context clearly dictates otherwise.

The terms "comprising", "comprises" and "comprised of" as used herein are synonymous with "including", "includes" or "containing", "contains", and are inclusive or open-ended and do not exclude additional, non-recited members, elements or method steps. The terms "comprising", "comprises" and "comprised of" when referring to recited members, elements or method steps also include embodiments which "consist of" said recited members, elements or method steps.

Furthermore, the terms first, second, third and the like in the description and in the claims, are used for distinguishing between similar elements and not necessarily for describing a sequential or chronological order, unless specified. It is to be understood that the terms so used are interchangeable under appropriate circumstances and that the embodiments of the invention described herein are capable of operation in other sequences than described or illustrated herein.

Unless otherwise defined, all terms used in disclosing the invention, including technical and scientific terms, have the meaning as commonly understood by one of ordinary skill in the art to which this invention belongs. By means of further guidance, definitions for the terms used in the description are included to better appreciate the teaching of the present invention. The terms or definitions used herein are provided solely to aid in the understanding of the invention. All documents cited in the present specification are incorporated by reference in their entirety.

The recitation of numerical ranges by endpoints includes all numbers and fractions subsumed within the respective ranges, as well as the recited endpoints.

The term "about" is used to provide flexibility to a numerical range endpoint by providing that a given value may be "a little above" or "a little below" the endpoint. Unless otherwise stated, use of the term "about" in accordance with a specific number or numerical range should also be understood to provide support for such numerical terms or range without the term "about". For example, for the sake of convenience and brevity, when referring to a measurable value such as a parameter, an amount, a temporal duration, and the like, is meant to encompass variations of +/−10% or less, preferably +/−5% or less, more preferably +/−1% or less, and still more preferably +/−0.1% or less of and from the specified value, insofar such variations are appropriate to perform in the present disclosure. It is to be understood that the value to which the modifier "about" refers is itself also specifically, and preferably, disclosed.

The term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

Reference throughout this specification to "one embodiment" or "an embodiment" means that a particular feature, structure or characteristic described in connection with the embodiment is included in at least one embodiment of the present disclosure. Thus, appearances of the phrases "in one embodiment" or "in an embodiment" in various places throughout this specification are not necessarily all referring to the same embodiment. Occurrences of the phrase "in one embodiment," or "in one aspect," herein do not necessarily all refer to the same embodiment or aspect.

Furthermore, the particular features, structures or characteristics may be combined in any suitable manner, as would be apparent to a person skilled in the art from this disclosure, in one or more embodiments. Furthermore, while some embodiments described herein include some, but not other features included in other embodiments, combinations of features of different embodiments are meant to be within the scope of the present disclosure, and form different embodiments, as would be understood by those in the art. For example, in the following claims and description, any of the claimed or described embodiments can be used in any combination.

The present invention aims to provide a solution to the above-identified problems in the art by providing a movement assisting apparatus as described in the present disclosure for training a subject. The subject may be a human, such as a healthy human or a patient suffering from an abnormal health condition.

Preferably the subject may be a movement impaired with limited control of his/her lower body. Preferably the subject may be mild to seriously disabled. The subject may, for example, be affected by cerebral palsy, acquired brain and/or spinal injury, neurological conditions, multiple sclerosis, spina bifida or any other movement impairing condition.

The movement assisting apparatus as described in the present disclosure can improve the user-friendliness and access for the subject to person to engage with the apparatus and adjust the training programme with limited assistance. Moreover, the present apparatus can provide for improved comfort which can improve the subject adherence to the training programme, thereby resulting in better health improvements. Additional advantages brought about by embodiments of the present apparatus are discussed throughout the present disclosure.

An initial overview of various components of the apparatus is provided below and specific embodiments are then described in further detail. This initial overview is intended to aid readers in understanding the technological concepts more quickly, but is not intended to identify key or essential features thereof, nor is it intended to limit the scope of the present subject-matter.

In addition, one of ordinary skill in the art understands, and based on a reading of this detailed description, would recognize that that the various aspects can be combined unless otherwise stated. As such, any specific embodiment of a specific aspect may be understood to constitute a specific embodiment of another aspect without the explicit discussion thereof. For example, an embodiment for the configuration of the device also forms an embodiment for the manufacture of said device, an embodiment for the use of said device, and so on.

An aspect of the present disclosure relates to an apparatus 10 for assisting the movement of a subject during a training session comprising:

- a frame having an elongated base and an upright support member 31 positioned at the front of the apparatus;
- a support unit 2 comprising a bottom support 21, a back support 22, an upper body securing device; and
- a switching mechanism 23 configured to selectively switch the position of said bottom 21 and back 22 supports between at least two states, namely a seated state wherein the bottom support 21 is substantially perpendicular to the back support 22, and a standing state wherein the bottom support 21 is substantially parallel preferably aligned with the back support 22, and vice versa;
- a movement assistance unit comprising, for each subject's leg, a foot fastener 33, a leg securing device 34, and a movement mechanism 32 consisting of an assembly of elongated bars hingedly connected to each other, including at least one vertical bar 321 that is pivotally coupled to the upright support member 31 and extends downward therefrom in a substantially vertical manner, and at least one horizontal bar 322 that is pivotally coupled to an opposite end of the apparatus and extends along the elongated base in a substantially horizontal manner, such that an elliptical leg movement path can be realised with said assembly; wherein the foot fastener 33 and leg securing device 34 are arranged on said horizontal bar 322;
- wherein the movement assistance unit comprises a pulling mechanism that is connected to each leg securing device 34 and is configured to pull one leg securing device 34 back when the other leg securing device 34 moves forward, thereby providing an alternating leg movement.

The components of the support unit 2 will be discussed with reference to the attached figures. As illustrated in FIG. 1A, the support unit 2 may comprise a bottom support 21 for supporting the subject's bottom and a back support 22 for supporting the subject's back. In an embodiment the bottom support 21 may be a seat, preferably a flat seat. Preferably the bottom support 21 can extend forward to also support at least a portion of the subject's legs when seated. In an embodiment the back support 22 may be a backrest, preferably a flat backrest.

Figure 3A:
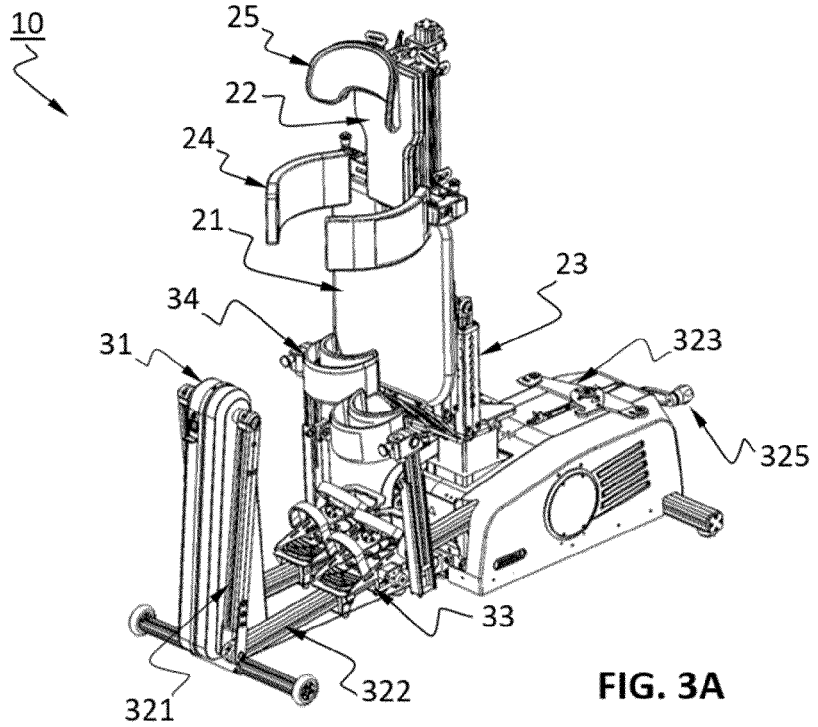
FIG. 3A is a perspective view and FIG. 3B a sideways view of the disclosed apparatus 10 in a standing state.

Connected to the bottom support 21 and the back support 22 may be a switching mechanism 23 that is configured to selectively switch the position of said bottom 21 and back 22 supports between at least two states, namely a first seated state (see FIG. 1A) wherein the bottom support 21 is disposed substantially perpendicular to the back support 22, essentially forming a seating arrangement for the subject to sit on, and a second standing state (see FIG. 3A) wherein the bottom support 21 is disposed substantially parallel to the back support 22, and vice versa.

Figure 2A:
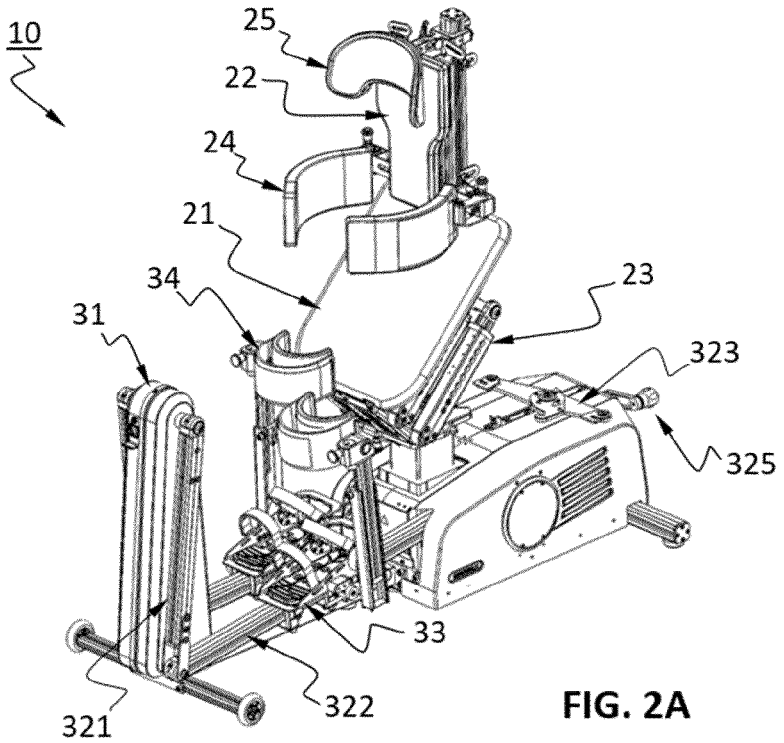
FIG. 2A is a perspective view and FIG. 2B a sideways view of the disclosed apparatus 10 in a transitional state, between the seated and standing states.

In an embodiment, the switching mechanism 23 may be configured to set the position of said bottom 21 and back 22 supports in any state between the above-describe seated and standing states. Accordingly, the switching mechanism 23 may be configured selectively switch the position of said bottom 21 and back 22 supports between at least three states, such as an intermediate state. For example, FIG. 2A shows an intermediate state between the seated state of FIG. 1A and the standing state of FIG. 3A.

Figure 1B:
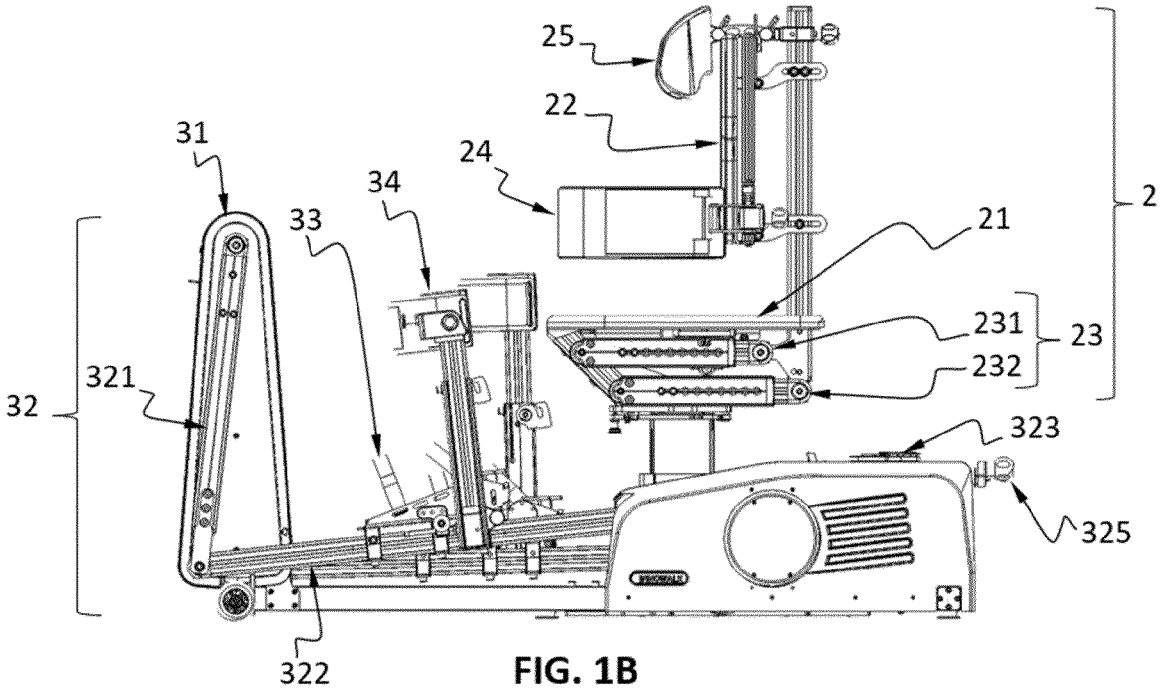

In an embodiment the switching mechanism 23 may comprise an assembly of at least two adjacently arranged rods, namely an upper rod 231 and a lower rod 232, which are hinged in the corners and rotatably coupled to the bottom 21 and back 22 support. Preferably, these rods are of substantially equal length, but the corners are connected to the bottom 21 and back 22 support at a shifted position relative to each other so as to form a vertical parallelogram. Advantageously, a connective component may be provided that extends at an oblique angle from the bottom support towards the apparatus support frame and the edges of said upper 321 and lower rods 322 may be rotatably coupled thereto. An exemplary arrangement thereof is shown in FIG. 1B.

Figure 2B:
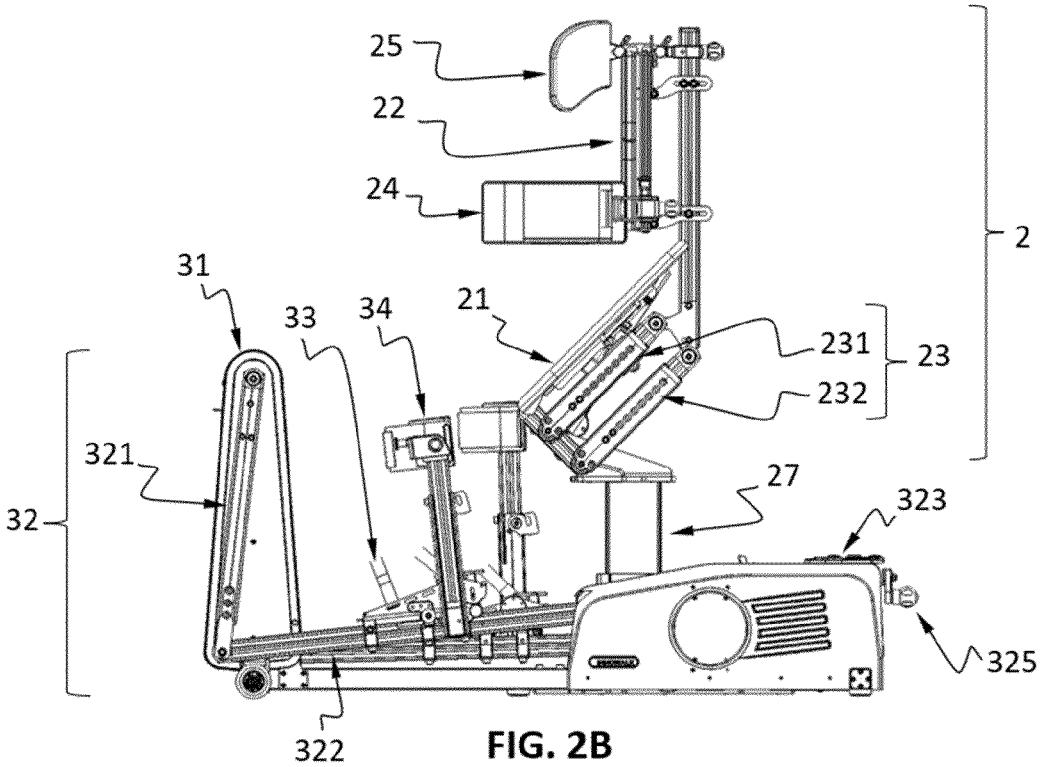
Figure 3B:
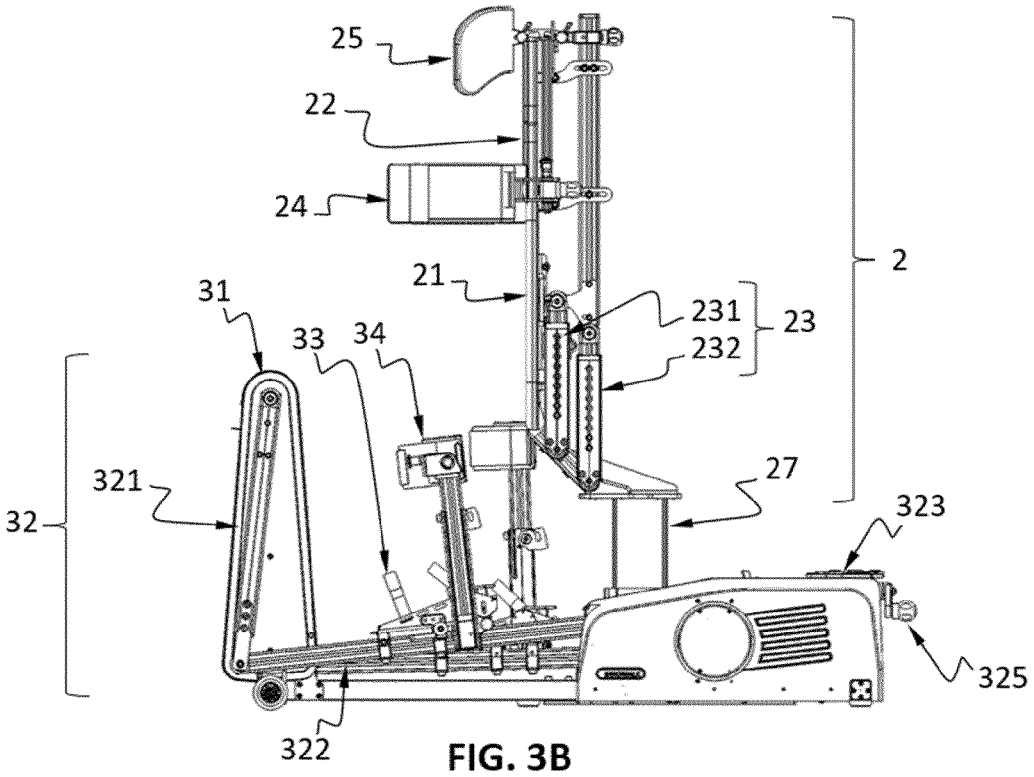

Rotation of the assembly of rods of the switching mechanism 23 can rotate the bottom support 21 along a substantially 90 degrees angle and simultaneously raise the position of the back support 22 such that the bottom and back supports can align with each other, preferably to form a straight line which can better support the subject's spinal column. An exemplary arrangement thereof is shown in FIG. 3B. Further, FIG. 2B shows the transition from the seated state of FIG. 1B into the standing state of FIG. 3B.

Figure 5A:
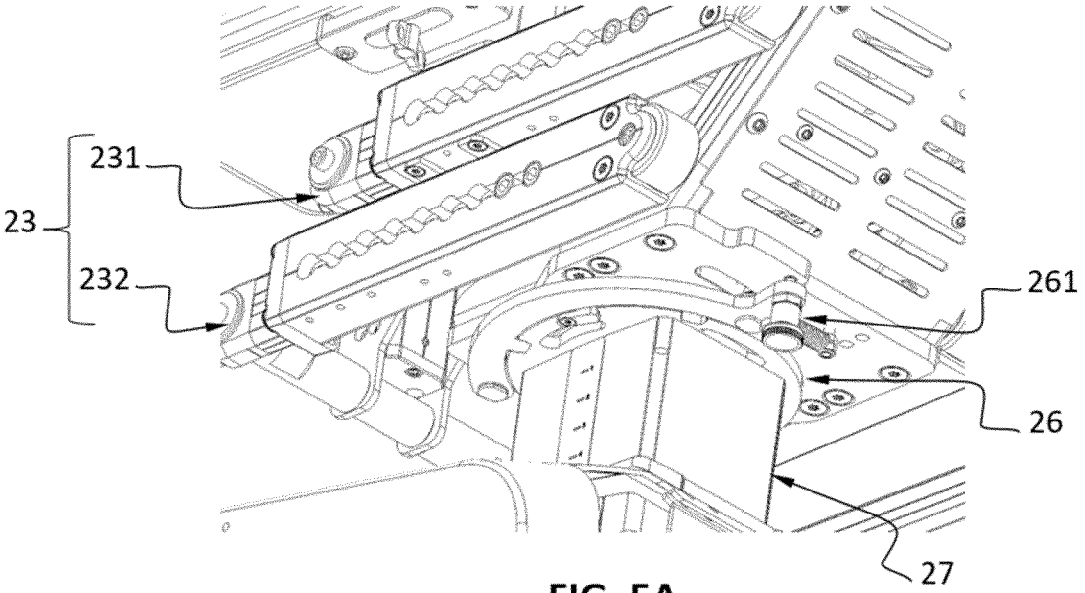
FIG. 5A is a focused view of the switching mechanism 23 and rotatable base 26 of the present apparatus 10.

In an embodiment the upper rod 231 and the lower rod 232 of the above-described assembly can be extendable in length for a deeper sitting position. This may improve the comfort for taller subjects and ensure that the rotation is kept around the subject's knee joint. Preferably the upper 231 and lower 232 rods are telescopically extendable by consisting of two or more complementary rods that are configured to slidably engage with each other. Optionally the upper 231 and lower 232 may be provide with openings to lock each rod at the optimal length. An exemplary embodiment thereof is illustrated in FIG. 5A.

In an embodiment support unit 2 may comprise an upper body securing device for securing the subject's upper body. In an embodiment the upper body securing device may comprise at least one moveably arranged locking member that is configured to contact the subject's upper body and lock it in place against the bottom 21 and back 22 support. For example, the upper body securing device may comprise a strap, belt, or the like.

In an embodiment the upper body securing device may comprise two or more lateral engaging members 24 that are arranged on opposite sides of the apparatus, preferably the back support 22, and are configured to, preferably simultaneously, contact a portion of the subject's upper body, preferably the subject's side underneath the arms. In combination with the above-described bottom 21 and back 22 support this can form a multi-point contact arrangement that can fully support the subject's upper body during transition from the seated to the standing state and/or during the training session.

Preferably the lateral engaging members 24 are positioned at the height of the subject's hip area to secure the subject's hip upon said engagement. Advantageously the lateral engaging members 24 are curved so as to accommodate the natural body shape. In a preferred embodiment the lateral engaging members 24 may be configured to rotate inwards to secure the subject (see FIG. 1A) and rotate outwards to release the subject (see FIG. 4A). This arrangement can improve the subject's ease of access into the apparatus.

In an embodiment the support unit 2 may comprise a head support 25 for supporting the subject's head.

In ab embodiment the head support 25 may be a headrest, preferably a curved headrest. Preferably the head support 25 may be arranged a top position of the back support 22 such that it moves along with the back support 22 when it switches from the seated to the standing state. Advantageously the position and/or angle of the head support 25 can be adjusted to accommodate the subject's height.

In an embodiment the support unit 2 may be mounted on a rotatable base 26 configured to rotate the support unit 2 around the apparatus' vertical axis such that at least the bottom support 21, the back support 22 can be oriented sideways for subject entry (i.e., to allow the subject to enter or exit the device.

Figure 4A:
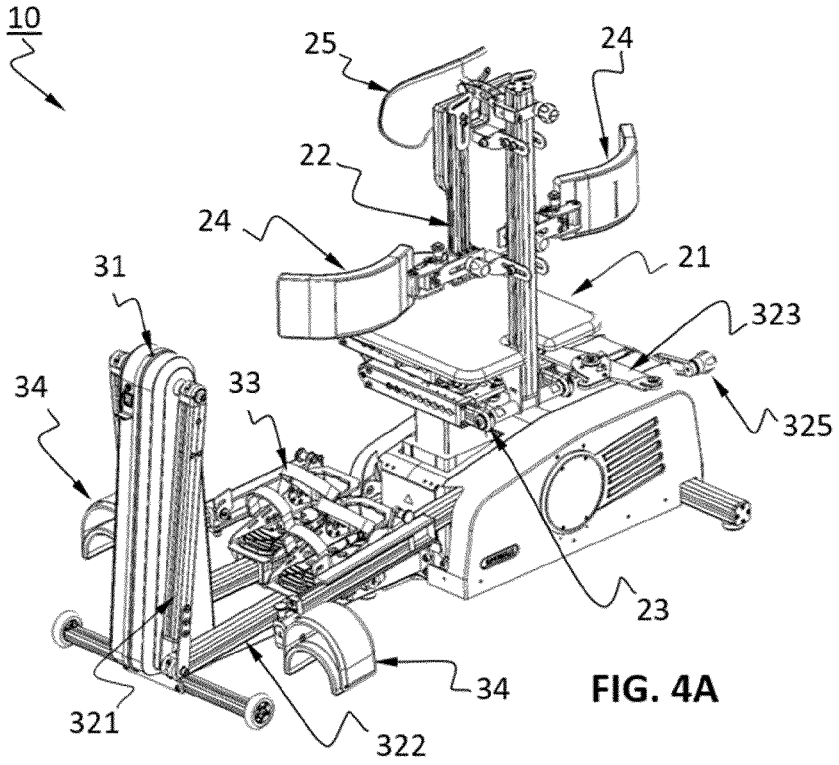
FIG. 4A is a perspective view and FIG. 4B a top view of the present apparatus 10 for subject entry.
Figure 4B:
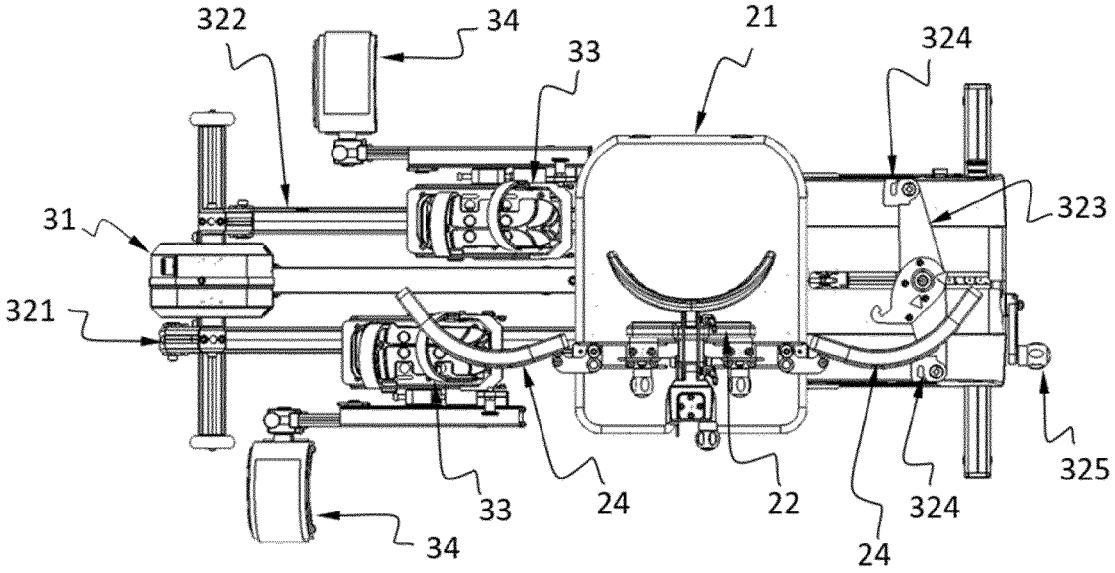

Advantageously, all the components of the support unit 2 may be rotated sideways, which may also include the upper body securing device and/or the head support 25. This can ease the subject entry and exit into the apparatus from a side of the apparatus, which can be particularly beneficial for wheelchair-bound subject. An exemplary arrangement thereof is shown in FIG. 4A and FIG. 4B. Optionally, the rotatable base may comprise a rotary actuator configured to automatically rotate said rotatable base and any components thereof, such as gears, rings, belts, bearings, etc.

Figure 5B:
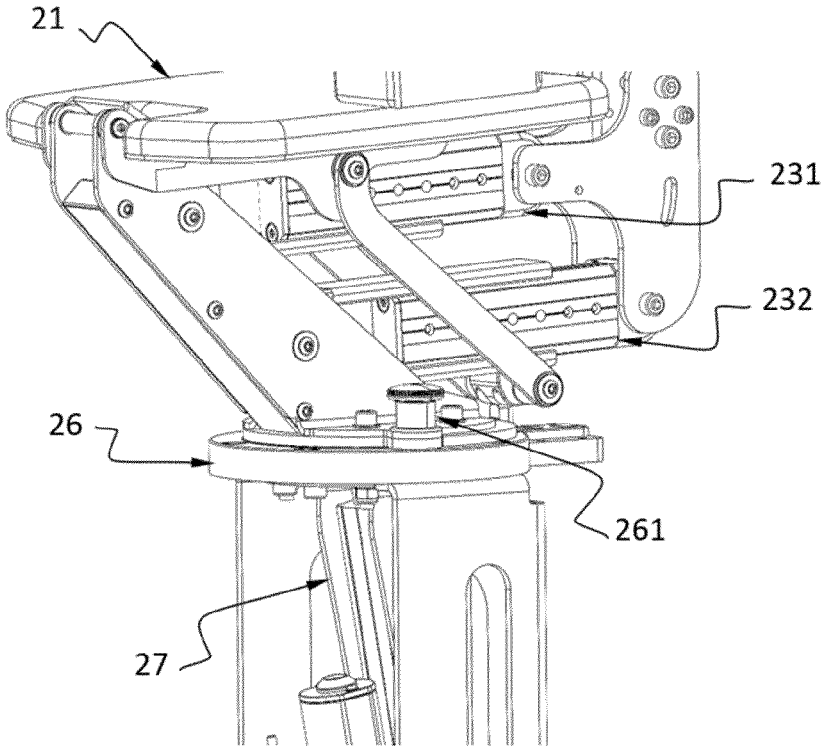
FIG. 5B is a partially sectional view of the switching mechanism 23 and rotatable base 26 of the present apparatus 10.

In an embodiment the rotatable base 26 may comprise a locking member 261 configured to lock the rotation of the rotatable base 26. Preferably the locking member 261 may lock the rotatable base 26 at least two predefined orientations, namely a forward orientation for subject training and a sideways orientation for subject entry. Further, the locking member may also lock the rotatable base 26 at any orientations in between. Advantageously the locking member 261 may be biased towards the rotatable base 26 such that it self-locks when released. For example, the locking member 261 may be spring-loaded. An exemplary embodiment thereof is illustrated in FIG. 5A and FIG. 5B. This provides a reliable lock to prevents accidental rotation of the rotatable base 26 for example during subject entry.

Figure 5C:
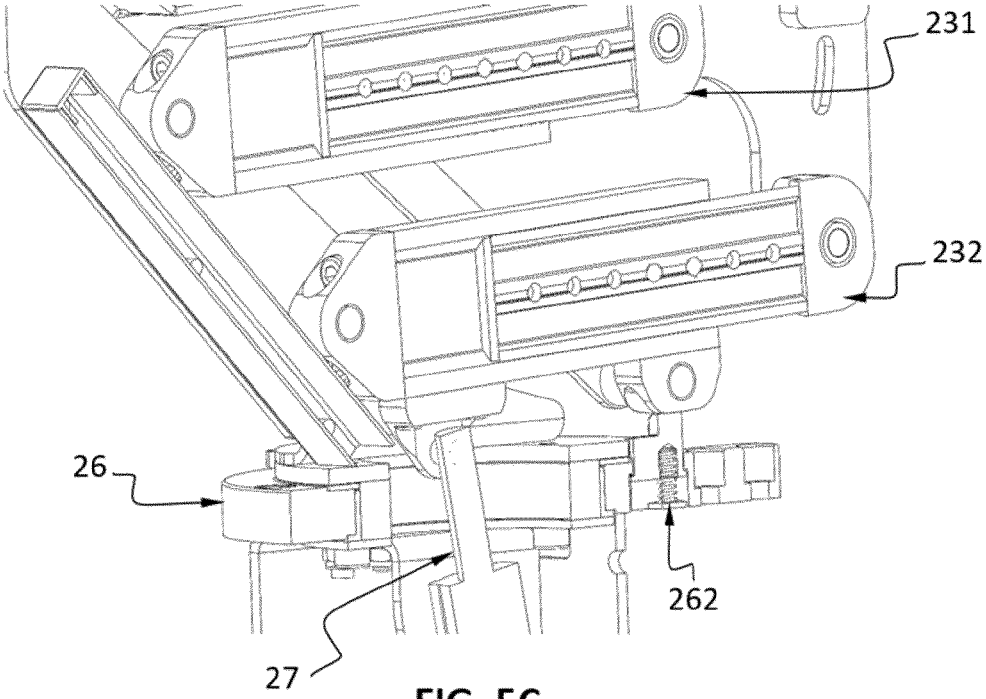
FIG. 5C is a sectional view of the switching mechanism 23 and rotatable base 26 of the present apparatus 10.

In an embodiment the rotatable base 26 may comprise a moveably arranged locking member 262 that is biased towards the above-described switching mechanism 23 preferably the assembly of the upper 231 and lower 232 rods such that it self-unlocks the rotatable base 26 when the switching mechanism 23 is in the seated state. Preferably, the switching mechanism 23 can be arranged such that the lower rod 232 and/or of a connective member extending therefrom can push out the moveably arranged locking member 261 when in a seated state such that the rotatable base 26 unlocks. An exemplary embodiment thereof is illustrated in FIG. 5A and FIG. 5C. This provides a reliable safety mechanism that prevent accidental rotation of the rotatable base 26 during a training session.

Figure 6:
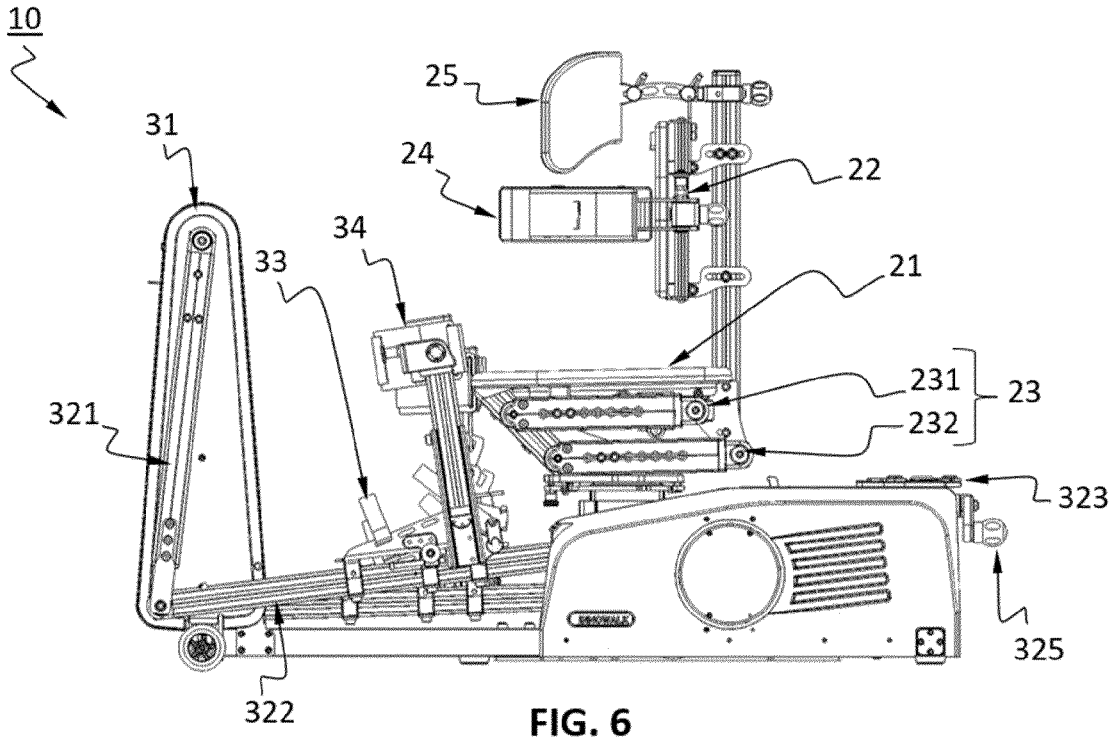
FIG. 6 is a sideways view of the present apparatus 10 with the support unit 2 in a lowered position.

In an embodiment the support unit 2 may be mounted on a height-adjustable base 27 that is configured to raise and lower the height of the support unit 2 relative to the apparatus frame, preferably the movement unit disposed underneath. This can allow adjustment of the apparatus to a subject's height, which can be particularly beneficial for younger subjects. An exemplary arrangement thereof is shown in FIG. 5 and FIG. 6. Optionally, the height-adjustable base 27 may comprise a linear actuator configured to raise and lower said height-adjustable base and any components thereof, such as gears, rings, belts, bearings, etc.

The components of the movement assistance unit will also be discussed with reference to the attached figures. As illustrated in FIG. 1A, the movement assisting unit comprises a frame having an elongated base and an upright support member 31, which is preferably arranged at a front end of the elongated base. The apparatus may further comprise a number of pedestals, which are preferably arranged at each corner of the elongated base so as to stabilise the apparatus during training.

Coupled to the frame may be a movement mechanism that is configured to assist and coordinate alternated leg movement of the subject to simulate a natural and repetitive movement cycle. The movement mechanism may be arranged in a suspended manner to enable assisted leg movement along an elliptical path such that the subject's foot goes up and down as well as back and forth during a movement cycle. This way a more natural walking motion can be simulated.

In an embodiment the movement mechanism may comprise an assembly of elongated bars that are hinged in the corners so as to move rotate relative to each other. The first rod 321 can at its free end be rotatably coupled to the upright support member 31 and extend downward from said upright support member 31 in a substantially vertical manner to form a vertical component of the movement mechanism 32; and the second rod 322 can be rotatably coupled to the opposite end of the apparatus and extend along the elongated base in a substantially horizontal manner to form a horizontal component of the movement mechanism 32. The skilled person will understand that two such assemblies may be provided, one for each subject's. An exemplary arrangement thereof is shown in FIG. 1B. This assembly provides a particularly efficient way to realise the above-described elliptical leg movement path.

In an embodiment the movement assistance unit may comprise a foot fastener 33 configured for fastening a foot of the subject to the movement mechanism. Preferably the foot fastener 33 may be arranged on an upper surface of the horizontal bar 322 of the above-described assembly. For example, the horizontal bar 322 may be provided with a hollow recess to which the foot fastener or a component thereof can be connected.

In an embodiment the foot fastener 33 may comprise a fastening device, such as a strap or brace. Alternatively, the foot fastener may be configured to connect with the subject's footwear such as a clip provided on the sole of said footwear. This can improve the user friendliness and comfort.

In an embodiment the movement assistance unit may comprise a leg securing device 34 for securing the subject's legs. Preferably the leg securing device may comprise at least one moveably arranged locking member that is configured to contact one of the subject's legs and lock it in place against the movement mechanism. For example, the upper body securing device may comprise a strap, belt, or the like. The leg securing device may be connected the horizontal bar 322 of the above-described assembly. Preferably the leg securing device is arranged perpendicular to the top surface of said horizontal bar 322. For example, a connective bar may be provided that connects to a side surface of said horizontal bar 322 near the position of the above-described foot fastener 33.

Figure 7A:
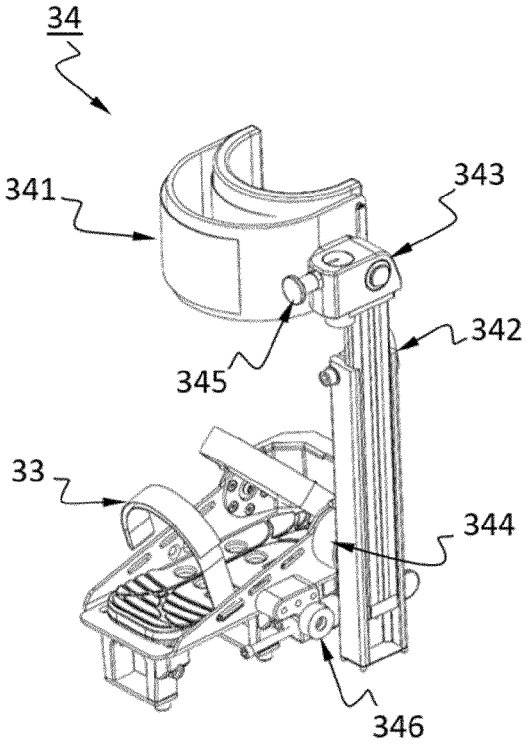
FIG. 7A is a perspective view of the present leg securing mechanism 34 in a closed position.

In an embodiment the leg securing device 34 may comprise a leg shackle 341 that is configured to contact and at least partially enclose the subject's leg, preferably the shinbone, more preferably the upper section of the shinbone. Preferably, the shackle 341 is at least partially open-ended preferably with an open back from which the subject's leg can enter. An exemplary embodiment of the leg securing device 34 is illustrated in FIG. 7A.

In an embodiment the shackle 341 may consist of rigid outer piece and a flexible inner piece that is configured to move towards the outer piece to reduce the pressure exerted on the subject's leg, preferably by absorbing some of the pressure exerted on the leg subject's leg when it is pulled back by the pulling mechanism which is described further below. The outer and inner pieces may be separated by a biasing member that partially resists pressure exerted on the subject's shin during leg movement to improve comfort.

In an embodiment the leg securing device 34 may comprise a height-adjusting mechanism 342 that is configured to adjust the height of the leg securing device 34, preferably the shackle 341, relative to the foot fastener 33. For example, the height-adjusting mechanism 342 may include an assembly of a first hollow profile and a second profile fit into said hollow profile and configured to slide in a longitudinal direction relative thereto, whereby the shackle the first profile is connected to the movement mechanism and the second profile is connected to the shackle 341. Advantageously the leg securing device 34, preferably the shackle 341, may be disposed at a height just below the subject's knee joint. This can increase the level of support provided by said securing device thereby improving the subject's comfort.

Figure 7B:
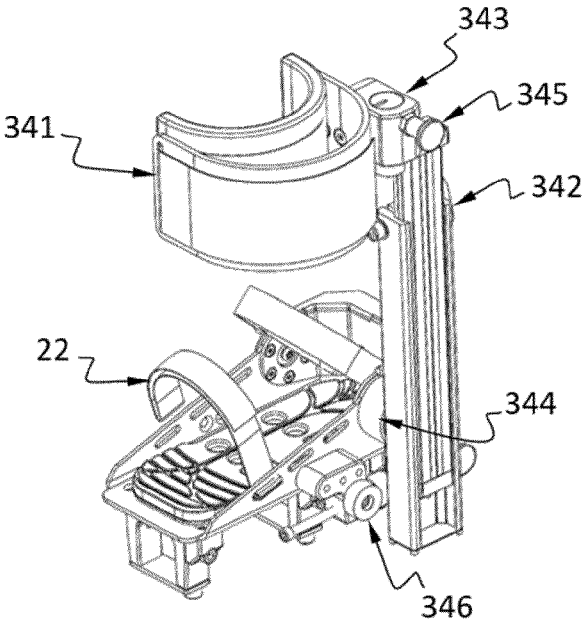
FIG. 7B is a perspective view of the present leg securing mechanism 34 in a partially opened position.
Figure 7C:
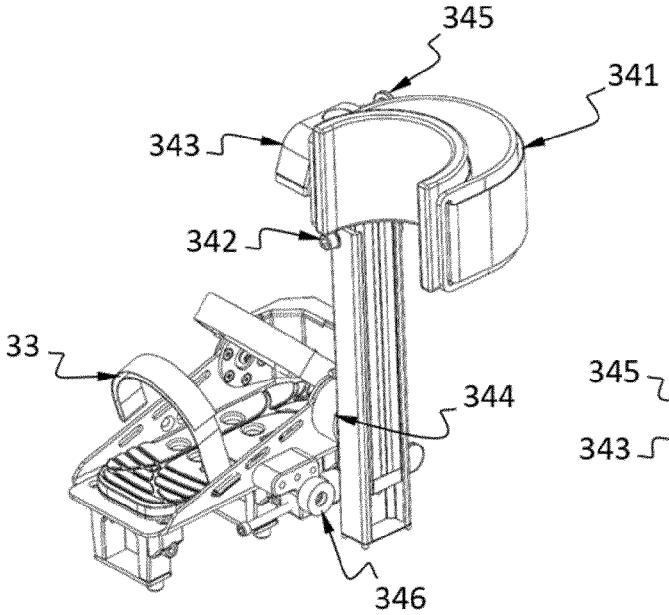
FIG. 7C is a perspective view of the present leg securing mechanism 34 in a fully opened position.

In an embodiment the leg securing device may comprise a pivoting mechanism 343 configured to rotate the leg securing device 34, preferably the shackle 341, around an axis perpendicular to the upper surface of the horizontal bar 322 of the movement mechanism. Advantageously the pivoting mechanism 343 may be configured to rotate leg securing device 34, preferably the shackle 341, around a longitudinal axis of the above-described height-adjusting mechanism 342. This arrangement can enable a rotation of said shackle 341 to multiple positions, for instance, an inward position (see FIG. 7A) whereby the shackle 341 can secure the subject's leg, and a partially (see FIG. 7BA) or fully outward (see FIG. 7BA) position whereby the shackle 341 can release the subject's leg. This arrangement can improve the subject's ease of access into the apparatus.

In an embodiment the pivoting mechanism 343 may comprise a locking member 345 configured to lock said shackle 341 in one of said at least two position, including an inward position and an outward position. Advantageously the locking member may be biased towards the pivoting mechanism 343 such that it self-locks when released. For example, the locking member may be spring-loaded. The locking member may be configured to only lock the shackle 341 in predetermined positions including said at least two position. This provides a safety feature to prevent accidental rotation of the leg securing device 34, preferably the shackle 341, during a training cycle.

In an embodiment the leg securing device 34 may comprise a tilting mechanism 344 rotatably connected to the foot fastener 33 at the height of the subject's ankle; and configured to tilt the shackle around the ankle's axis of rotation 341. This may improve the subject's comfort by simulating a more natural walking motion during the training cycle.

Figure 8:
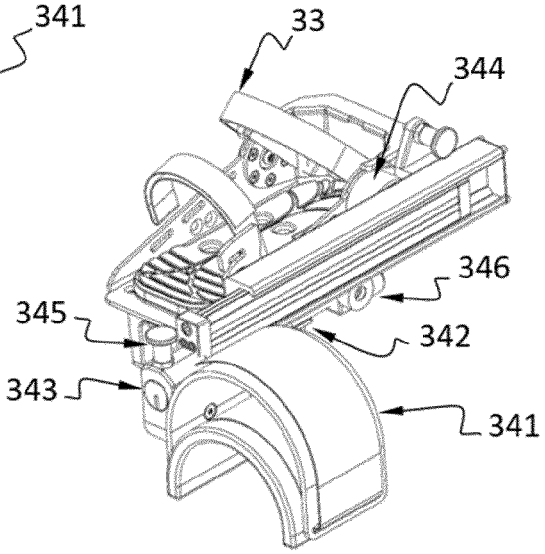
FIG. 8 is a perspective view of the present leg securing mechanism 34 in a tilted position for subject entry.

In an embodiment the tilting mechanism 344 may be configured to tilt the shackle 341 forward between at least two position, namely a downward position to enter the subject's leg and an upward position to secure the subject's leg. In particular, the tilting mechanism 344 may tilt the leg securing device 34, preferably the shackle 341, towards the foot fastener 33 arranged at the upper surface of the horizontal bar 322 of the movement mechanism. This arrangement can enable a downwards tilting of the shackle to provide space for passing the subject's leg over the movement mechanism, for example into the foot fastener 33. An exemplary embodiment thereof is illustrated in FIG. 8. This arrangement can improve the subject's ease of access into the apparatus.

In an embodiment the leg securing device 34 may comprise a stop member 346 that is configured to block at least a backward tilt of the shackle 341. This can provide a safety feature to prevent overstretching of the subject's knee during training. Preferably the stop member 346 is positioned below the tilting mechanism 344 and is configured to contact a portion of the leg securing device 34 extending below said tilting mechanism 344. This may provide a reliable stop member 346 that reduces the complexity of the leg securing device 34.

Advantageously, the tilting mechanism 344 may include a safety lock that blocks tilting of the shackle 341 when it is rotated inwards towards the subject's leg. In other words, the shackle 341 can only be tilted when it is rotated partially or fully outwards. For example, the safety lock may be connected to the above-described pivoting mechanism 343 and configured to release the tilting mechanism 344 when the shackle has been rotated outwards. This can provide a safety feature to prevent accidental leg release during training. For example, the blocking element may be connected to the pivoting mechanism and configured to release the tilting mechanism 344 when the shackle has been rotated outwards.

In an embodiment the movement mechanism 32 may comprise a pulling mechanism configured to alternate movement of the subject's legs during training to simulate a more natural walking motion on a stationary apparatus by moving one leg backwards as the other leg moves forward. This can be achieved by coupling the movement of the above-described movement mechanisms for each subject's leg. Preferably the pulling mechanism is provided in a rear end of the apparatus so as to not disrupt the subject's movement and also enable easy entry into the apparatus.

In an embodiment the pulling mechanism may comprise a swivelling body 323 preferably arranged in the rear of the apparatus. The swivelling body 323 may have at least two wire attachments 324 arranged at opposite ends thereof. This allows for each shackle 341 to be connected to a separate wire attachment 324 by means of a connecting wire such that the movement of each shackle is coupled to the rotation of said swivelling body 323. The connecting wire may a rigid wire or a flexible wire, such as an elastic band. The material of the wire may impact the training intensity. An exemplary arrangement thereof is shown in FIG. 4B. This assembly provides a particularly efficient way to alternate leg movement by actively pulling one leg backwards as the swivelling body 323 rotates due the other leg's forward movement. Also, it can prevent the subject's leg from collapsing and ensure a natural stretching of the leg muscles.

In an embodiment the pulling mechanism may comprise a tensioning mechanism 325 configured to adjust the position of the swivelling body 323 along the longitudinal axis of the elongated base to set the tension on the subject's leg. In particular, the rotation axis of the swivelling body 323 can be positioned to move closer towards or further away from the subject. For example, the tensioning mechanism 325 may comprise a crank connected to a wired shaft that linearly moves the swivelling body by turning said crank. This will simultaneously tension both the leg securing devices 34, preferably both shackles 341. Proper adjustment of the applied tension can improve the subject's comfort and prevents overstretching of the knee joint during training.

Figure 9:
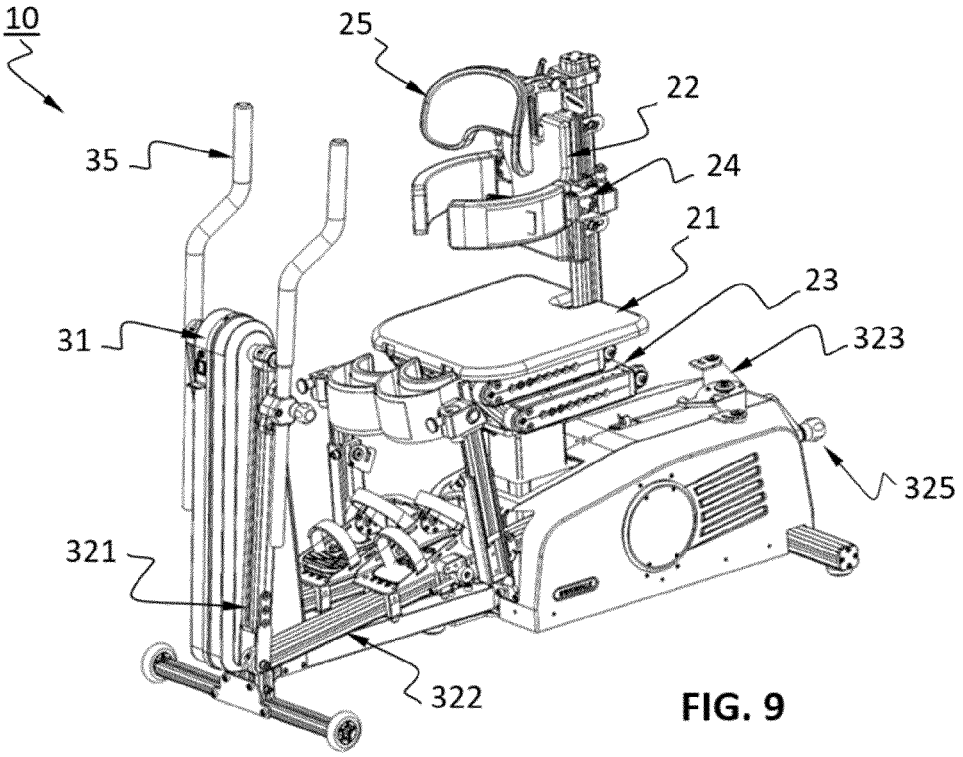
FIG. 9 is a perspective view of the present apparatus 10 with an extended hand holder 35.

In an embodiment the movement mechanism 32 may comprise a hand holder 35 configured for contact with the subject's hand during training, preferably for gripping. The hand holder 35 may include a fixture for placement of gripping bars along the movement mechanism 32. More preferably, the hand holder 35 may comprise gripping that extend from the vertical bar 321 of the movement mechanism and/or are connected thereto. This way the movement of the hand holder 35 can be synchronised with the movement of the leg securing device 34 provided on said vertical bar 321. An exemplary arrangement thereof is shown in FIG. 9. This assembly provides a particularly efficient way to also exercise the arms during the training cycle.

In an embodiment the apparatus may comprise a lifting mechanism 326 configured for lifting a part of the apparatus relative to the ground. Preferably, the lifting mechanism 326 is arranged at a front end of the apparatus such that the movement assistance unit can simulate an upward movement for the subject.

Figure 10:
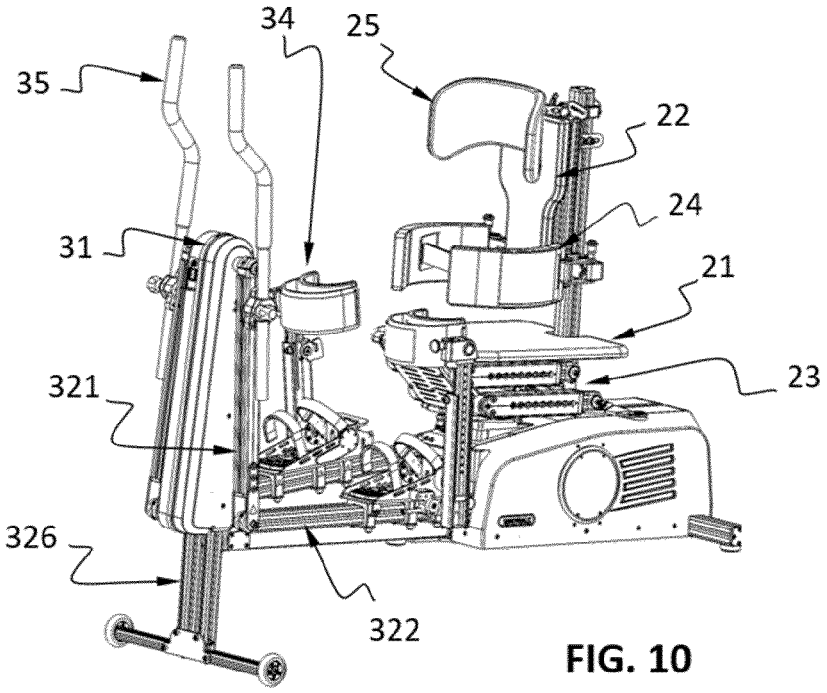
FIG. 10 is a perspective view of the present apparatus 10 with an extended lifting mechanism 326.

The lifting mechanism may be disposed within or below the upright support member 31. An exemplary arrangement thereof is shown in FIG. 10.

In an embodiment the apparatus may comprise at least one retractable wheel 5. Preferably the apparatus comprises a plurality of retractable wheels, for example two wheels that are positioned at opposite sides of the apparatus. Additionally, the apparatus may comprise regular wheels that are not retractable but can be preferably locked to prevent accidental movement of the apparatus during training.

Figure 11A:
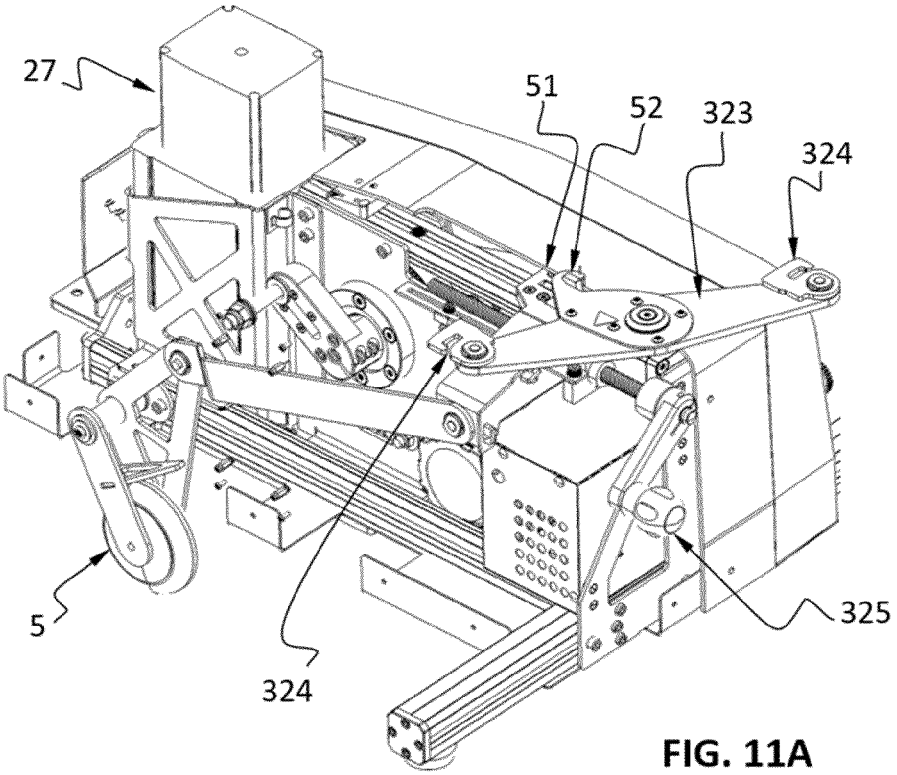
FIG. 11A is sectional view of the present apparatus 10 with an extended wheel 5.
Figure 11B:
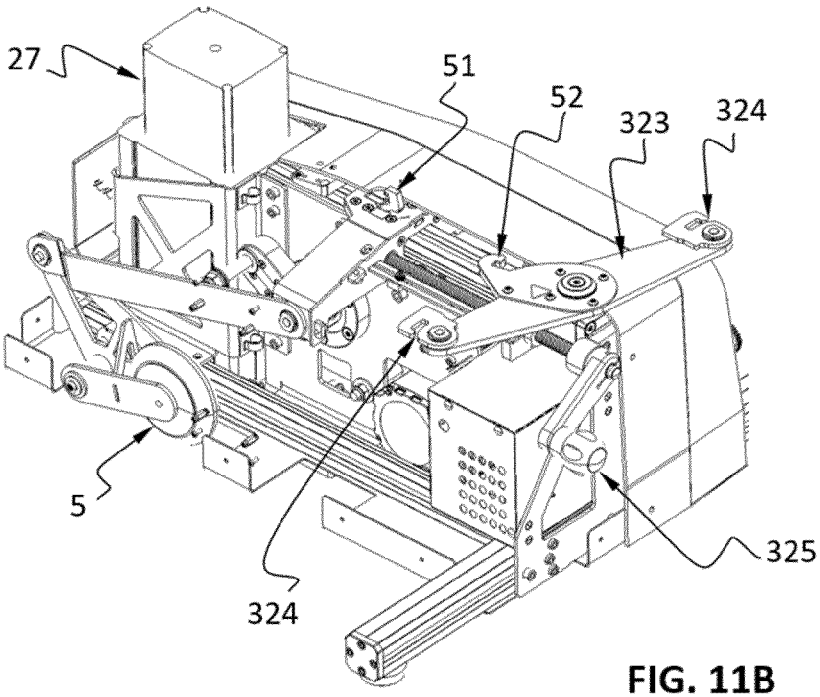
FIG. 11B is sectional view of the present apparatus 10 with a retracted wheel 5.

In an embodiment retractable wheel can be connected to a retracting mechanism 51 configured to reversibly extend and retract said retractable wheel 5. The retracting mechanism 51 may include for example a crank, which when activated extends said wheel from a bottom of the apparatus towards the ground. Accordingly, when the wheel is extended (see FIG. 11A) the apparatus can be freely moved about to a new position whereas when the wheel is retracted (see FIG. 11B) the apparatus can remain stationary by firmly connecting to the floor, for example by means of the above-described pedestals.

In an embodiment the retracting mechanism 51 may be connected to a locking member 52 configured to lock the retracting mechanism 51 when the position of the swivelling body 323 is adjusted by the tensioning mechanism 325. Preferably, the locking member 52 may be disposed on the swivelling body 323 of the pulling mechanism. As the position of the swivelling body 323 is adjusted by the tensioning mechanism 325 to provide tension on the shackle 343, the connection between the retracting mechanism 51 and the locking member 52 will prevent said retracting mechanism 51 from extending the retractable wheel 5. This provides a safety feature that prevent accidental extension of the retractable wheel 5 during a training session.

The invention claimed is:

1. An apparatus for assisting the movement of a subject during a training session comprising:

a frame having an elongated base and an upright support member positioned at the front of the apparatus;

a support unit comprising a bottom support, a back support, an upper body securing device and a switching mechanism configured to selectively switch the position of the bottom and back supports between at least two states, a seated state wherein the bottom support is substantially perpendicular to the back support, and a standing state wherein the bottom support is substantially parallel, optionally aligned, with the back support;

a movement assistance unit comprising, for each of the subject's legs, a foot fastener, a leg securing device, and a movement mechanism consisting of an assembly of elongated bars hingedly connected to each other, including at least one vertical bar that is pivotally coupled to the upright support member and extends downward therefrom in a substantially vertical manner, and at least one horizontal bar that is pivotally coupled to an opposite end of the apparatus and extends along the elongated base in a substantially horizontal manner, wherein an elliptical leg movement path can be realised with the assembly; wherein the foot fastener and leg securing device are arranged on the horizontal bar; and, wherein the leg securing device comprises a shackle and a height-adjusting mechanism configured to adjust the height of the shackle to a position adjacent to, or below, the subject's knee joint; wherein the shackle secures the subject's leg at the pivot point of the knee when the switching mechanism switches between the seated and standing states; and wherein the movement assistance unit comprises a pulling mechanism that is connected to each shackle and is configured to pull one shackle back when the other shackle moves forward, thereby providing an alternating leg movement.

2. The apparatus according to claim 1, wherein the support unit is mounted on a rotatable base configured to rotate the support unit around the apparatus' vertical axis wherein at least the bottom support and the back support can be oriented sideways for subject entry.

3. The apparatus according to claim 1, wherein the leg securing device comprises a pivoting mechanism configured to rotate the shackle around a longitudinal axis of the height-adjusting mechanism; wherein the shackle can be rotated between at least two positions, an inward position to secure the subject's leg and an outward position to release the subject's leg; optionally wherein the pivoting mechanism comprises a locking member configured to lock the shackle in one of the at least two positions.

4. The apparatus according to claim 1, wherein the leg securing device comprises a tilting mechanism rotatably connected to the foot fastener at the height of the subject's ankle; and configured to tilt the shackle around the ankle's axis of rotation.

5. The apparatus according to claim 4, wherein the leg securing device comprises a stop member that is configured to block at least a backward tilt of the shackle to prevent overstretching of the subject's knee; wherein the stop member is positioned below the tilting mechanism and is configured to contact a portion of the leg securing device extending below the tilting mechanism.

6. The apparatus according to claim 1, wherein the tilting mechanism is configured to tilt the shackle forward between at least two positions, a downward position to enter the subject's leg and an upward position to secure the subject's leg.

7. The apparatus according to claim 1, wherein the shackle is at least partially open-ended and consists of a rigid outer piece and a flexible inner piece that is configured to move towards the outer piece to reduce the pressure exerted on the subject's leg.

8. The apparatus according to claim 1, wherein the switching mechanism comprises an assembly of at least two adjacent rods, an upper rod and a lower rod, which are rotatably connected at opposite ends to the bottom and back supports at an oblique angle so as to form a vertical parallelogram; whereby a rotation of the assembly simultaneously tilts the bottom support and lifts the back support to align in the standing state and intersect in the seated state.

9. The apparatus according to claim 8, wherein the switching mechanism comprises a moveably arranged locking member configured to lock the rotation of the rotatable base; wherein the locking member is biased towards the assembly and is configured to unlock when the switching mechanism is in the seated state.

10. The apparatus according to claim 1, wherein the upper body securing device comprises at least two lateral engaging members arranged on either side of the back support and configured to laterally engage, optionally simultaneously, the subject's upper body under the arms.

11. The apparatus according to claim 1, wherein the pulling mechanism comprises a swivelling body arranged in the rear of the apparatus; wherein the swivelling body has at least two wire attachments arranged at opposite ends thereof; and wherein each shackle is connected to a separate wire attachment by means of a connecting wire wherein the movement of each shackle is coupled to the rotation of the swivelling body.

12. The apparatus according to claim 11, wherein the pulling mechanism comprises a tensioning mechanism configured to adjust the position of the swivelling body along the longitudinal axis of the elongated base to set the tension on the subject's leg.

13. The apparatus according to claim 12, wherein the retracting mechanism is connected to a locking member disposed on the swivelling body and configured to lock the retracting mechanism when the position of the swivelling body is adjusted by the tensioning mechanism.

14. The apparatus according to claim 1, wherein the apparatus comprises at least one retractable wheel and a retracting mechanism configured to reversibly extend and retract the wheel.

15. A method of use, the method comprising: providing the device of claim 1 and using the device to assist the movement of a subject during a training session.

16. The method according to claim 15, wherein the subject is disabled or movement impaired; wherein the subject is optionally affected by cerebral palsy, acquired brain or spinal injury, neurological conditions, multiple sclerosis, spina bifida or a movement impairing condition.

* * * * *